US007739817B2

(12) United States Patent
Hsu

(10) Patent No.: US 7,739,817 B2
(45) Date of Patent: Jun. 22, 2010

(54) THREE DIMENSIONAL INFLATABLE EXHIBITION PRODUCT WITH MOVING PARTICLES INSIDE THE EXHIBITION PRODUCT

(75) Inventor: Sheng-Hung Hsu, Renwu Hsiang (TW)

(73) Assignee: Gemmy Industries Corporation, Coppell, TX (US)

( * ) Notice: Subject to any disclaimer, the term of this patent is extended or adjusted under 35 U.S.C. 154(b) by 618 days.

(21) Appl. No.: 11/678,022

(22) Filed: Feb. 22, 2007

(65) Prior Publication Data

US 2008/0160876 A1 Jul. 3, 2008

(30) Foreign Application Priority Data

Dec. 27, 2006 (CN) ..... 2006 2 0164666

(51) Int. Cl.
*G09F 19/00* (2006.01)
*G09F 19/08* (2006.01)
*A63H 3/06* (2006.01)

(52) U.S. Cl. ..... 40/410; 40/439; 40/412; 446/220; 446/221; 446/224; 446/226

(58) Field of Classification Search ..... 40/410, 40/439, 412; 446/226, 221, 220, 224
See application file for complete search history.

(56) References Cited

U.S. PATENT DOCUMENTS 6,550,169 B1 * 4/2003 Sena et al. ..... 40/410
7,197,841 B2 * 4/2007 Hsu et al. ..... 40/412

* cited by examiner

*Primary Examiner*—Lesley Morris
*Assistant Examiner*—Syed A Islam
(74) *Attorney, Agent, or Firm*—Apex Juris, pllc; Tracy M Heims

(57) ABSTRACT

An inflatable exhibition product includes a primary inflatable product, an auxiliary characteristic inflatable product received inside and communicating with the hollow body of the primary inflatable product and an air blower assembly mounted at the bottom of the hollow body and having a hollow casing provided therein an upper chamber to receive therein a top blade set and a lower chamber to receive therein a bottom blade set. Rotation of the bottom blade set is able to inflate the auxiliary characteristic inflatable product and the primary inflatable product and rotation of the top blade set is able to suck in the particles from the inlet and project them out to the interior of the hollow body from the outlet.

10 Claims, 4 Drawing Sheets

THREE DIMENSIONAL INFLATABLE EXHIBITION PRODUCT WITH MOVING PARTICLES INSIDE THE EXHIBITION PRODUCT

BACKGROUND OF THE INVENTION

1. Field of the Invention

The present invention relates to an inflatable exhibition product, and more particularly to an inflatable exhibition product having multiple moving particles inside the exhibition product to increase its variety and attraction.

2. Description of the Prior Art

A conventional inflatable exhibition product often is placed on the shelf for display or at the entrance of a fair to mark the characteristic feature of the exhibition site or to function as an advertisement. This inflatable product is dull since it displays a static state of the product. There is no dynamic activity involved inside the inflatable product such that before long, people loose interest in the product despite how interesting the product is made.

To improve the shortcoming of the conventional static state inflatable product, a new kind of inflatable product is introduced to the market and has an air blower mounted inside the product, an inlet pipe extending from the air blower inlet and one end of which is extended out of the inflatable product and the other end of which is extended into the inflatable product and a first and a second outlet pipe extending from the air blower outlet in an air tight manner to respectively connect to a bottom and a side of the inflatable product, wherein the second outlet pipe corresponds to the chute.

When the inflatable product is in application, the air blower sucks air from outside the inflatable product so as to inflate the inflatable product. While the inflatable product is being inflated, the second outlet pipe sucks in particles inside the product and projects the particles to the top of the product to allow the particles to free fall inside the product. If the particles are made similar to snow flakes and falling directly from the interior of the product, the attraction of the inflatable product is greatly increased in that there is dynamic movement involved in addition to the provision of the static status of the inflatable product.

However, the particles are sucked due to siphoning effect, which requires lots of particles to accomplish the desired effect. In addition, the particles are not spread wide enough and limited within an area such that the effect to attract people's attention is not as good as expected.

To overcome the shortcomings, the present invention tends to provide an improved three dimensional inflatable product to mitigate the aforementioned problems.

SUMMARY OF THE INVENTION

The primary objective of the present invention is to provide a three dimensional inflatable product having two sets of blades to be responsible for the inflation of the product and for the movement of the particles inside the product respectively so that the inflation of the product and the movement of the particles are not affected with each other.

Another objective of the present invention is that inside the inflatable product, an auxiliary characteristic inflatable product is provided to communicate with the inflatable product and rotatable relative to the inflatable product.

Other objects, advantages and novel features of the invention will become more apparent from the following detailed description when taken in conjunction with the accompanying drawings.

DETAILED DESCRIPTION OF THE PREFERRED EMBODIMENT

Figure 1:
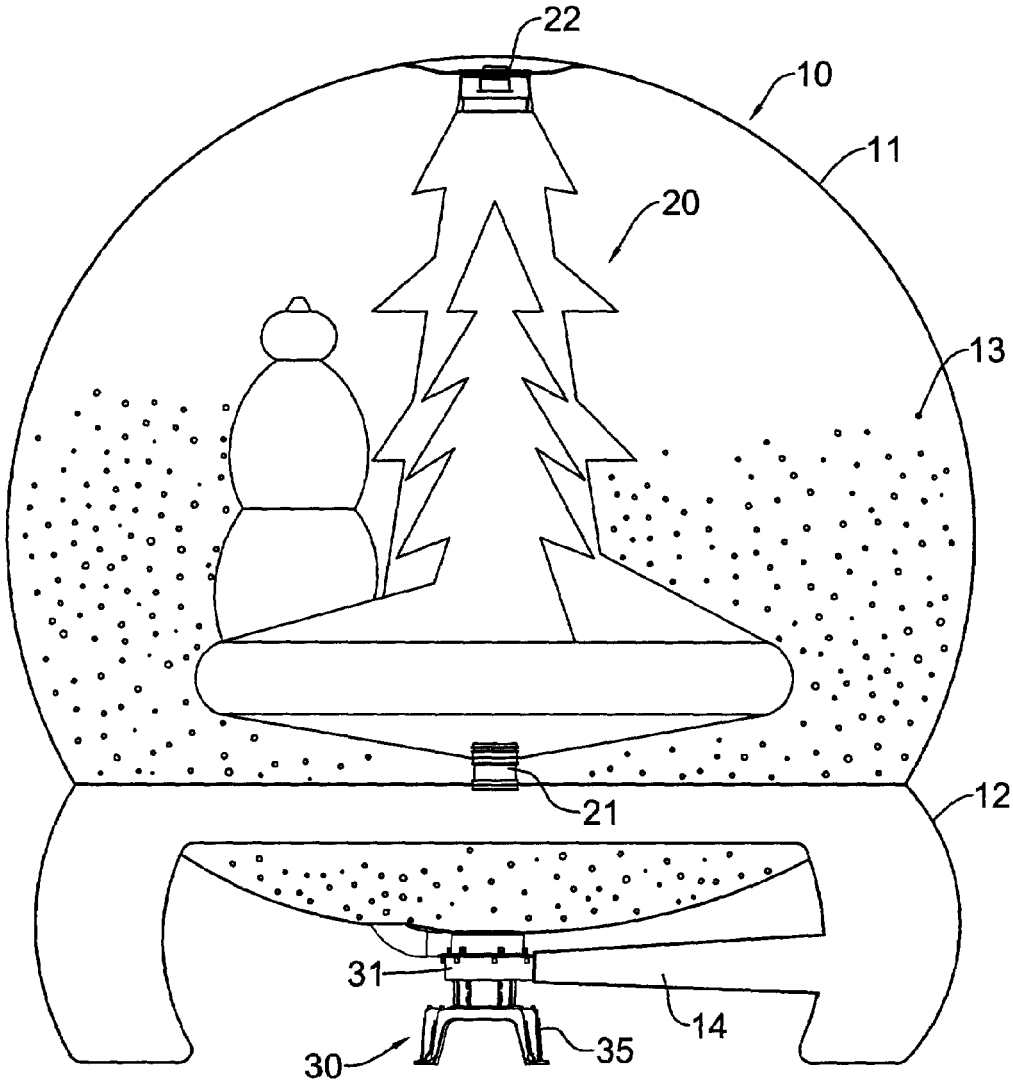
FIG. 1 is a schematic side plan view of the present invention.
Figure 2:
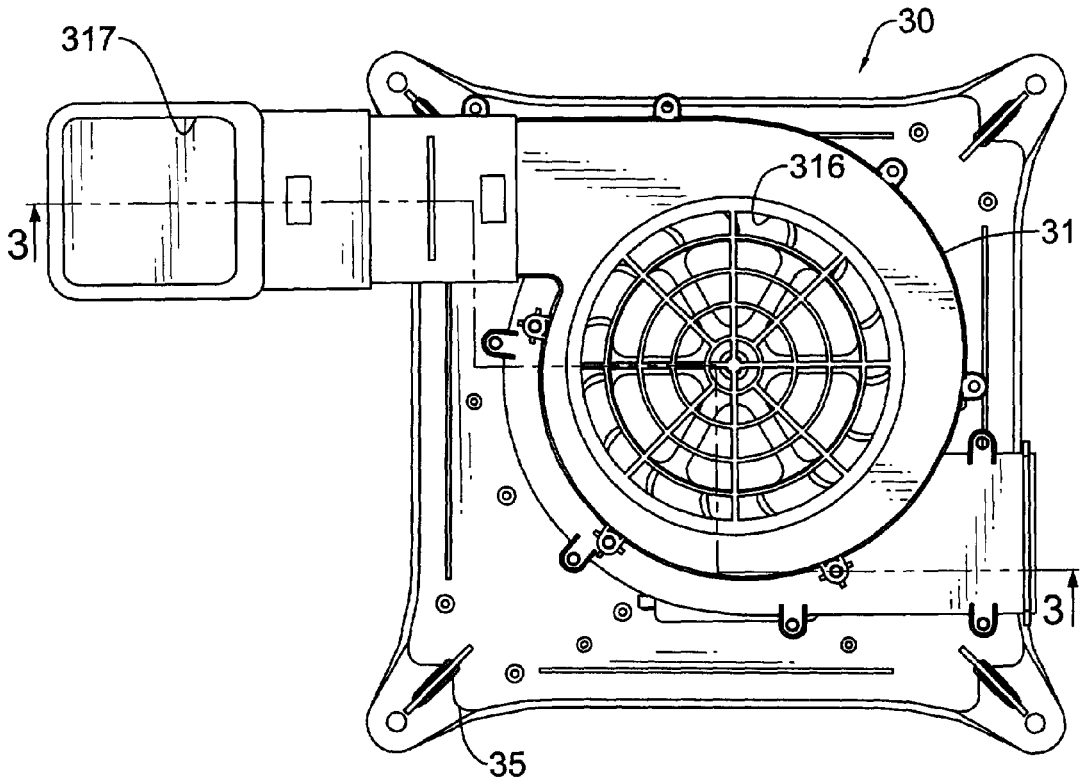
FIG. 2 is a top plan view of the air blower assembly of the present invention.
Figure 3:
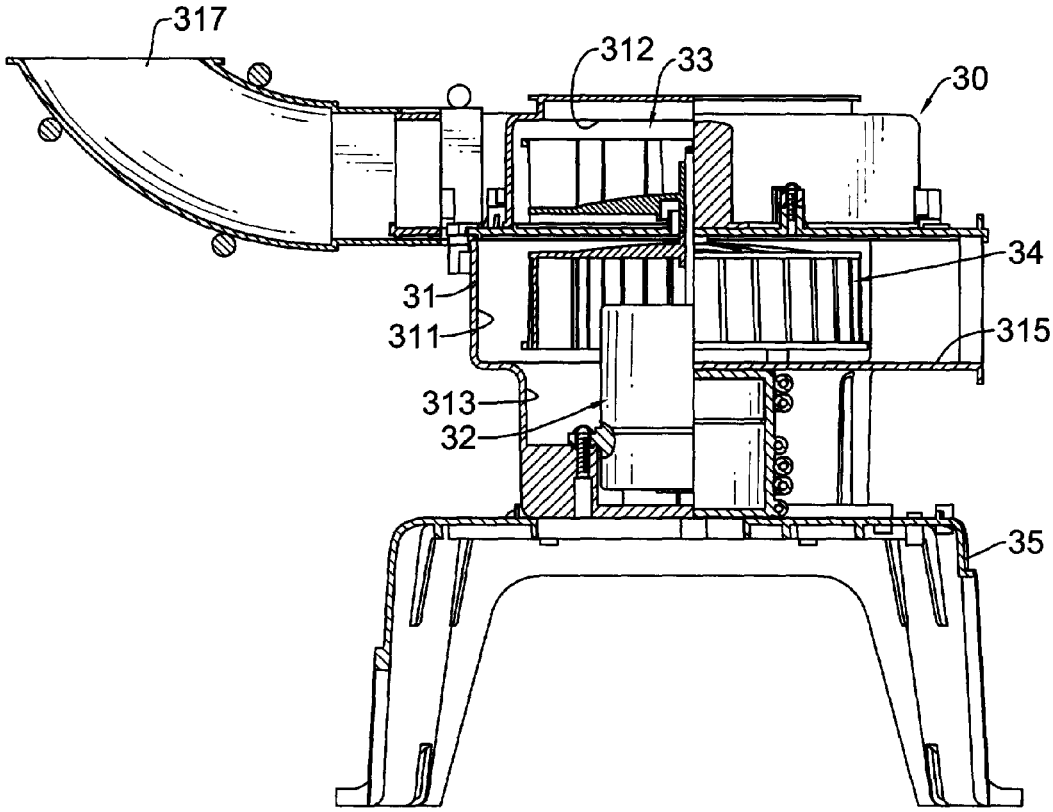
FIG. 3 is a schematic side plan view with partial in cross section to showing the air blower assembly of the present invention.

With reference to FIGS. 1, 2, and 3, it is noted that the inflatable exhibition product in accordance with the present invention includes a primary inflatable product (10), an auxiliary characteristic inflatable product (20) and an air blower assembly (30).

The primary inflatable product (10) includes a transparent, hollow body (11), a support (12) formed under and communicating with the hollow body (11), particles (13) randomly scattered inside the hollow body (11) and an extension pipe (14) integrally and laterally extending from a side of the support (12) and having an opening defined in a free end of the extension pipe (14), The auxiliary characteristic inflatable product (20) has a characteristic formation such as a castle, a Santa Clause, a tree . . . etc., and a hollow interior. The auxiliary characteristic inflatable product (20) is mounted inside the primary inflatable product (10). Preferably, a rotator (22) is mounted on top of the auxiliary characteristic inflatable product (20) and connected to an inner face of a top portion of the primary inflatable product (10) and a hollow rotation rod (21) is mounted on top of the support (12) to connect to a bottom of the auxiliary characteristic inflatable product (20). Furthermore, the hollow rotation rod (21) communicates the auxiliary characteristic inflatable product (20) with the primary inflatable product (10) and the rotator (22) is able to drive the auxiliary characteristic inflatable product (20) to rotate inside the primary inflatable product (10).

The air blower assembly (30) is mounted at the bottom of the hollow body (11) and comprises a hollow casing (31), a motor (32), a top blade set (33) and a bottom blade set (34).

The hollow casing (31) includes a lower chamber (311) to receive therein the bottom blade set (34), an upper chamber (312) communicating with the lower chamber (311) to receive therein the top blade set (33), a motor room (313) below the lower chamber (311) to receive therein the motor (32) and multiple feet (35) formed on a bottom of the hollow casing (31) to allow the hollow casing (31) to be above the ground. An opening is defined in a bottom face of the hollow casing (31) and a side opening (315) defined in a side face forming the lower chamber (311) to connect to and communicate with the extension pipe (14) of the support (12) of the primary inflatable product (10). An inlet (316) is defined in a top face forming the upper chamber (312) to communicate with the interior of the hollow body (11) of the primary inflatable product (10) and an outlet (317) defined in a side face forming the upper chamber (312) and extending laterally to communicate with the interior of the hollow body (11) of the primary inflatable product (10). Alternately, the motor (32) may also be mounted at the bottom of the casing (31).

The motor (32) has a motor shaft (not numbered) extending upward through the lower chamber (311) and the upper chamber (312) to respectively connect to the bottom blade set (34) and the top blade set (33).

Figure 4:
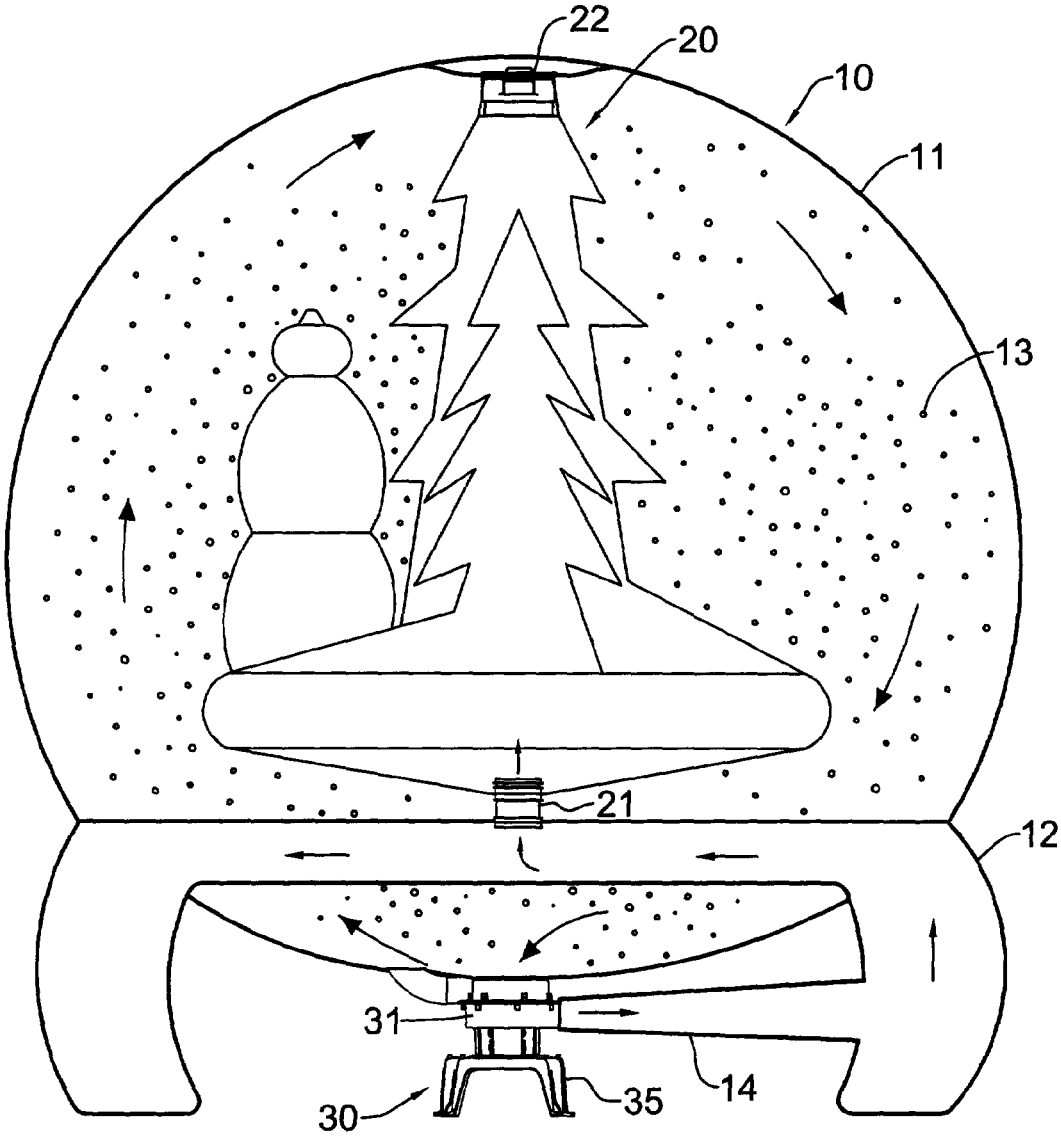
FIG. 4 is schematic view showing the application of the inflatable product of the present invention.

With reference to FIGS. 2-4, when the inflatable exhibition product of the present invention is in application, the bottom blade set (34) and the top blade set (33) both driven by the motor (32) are able to generate air flow, wherein air is drawn in from the opening at the bottom of the hollow casing (31) by the rotation of the bottom blade set (34) and flew to the extension pipe (14) of the support (12) so as to inflate the support (12) as well as the interior of the hollow body (11) of the primary inflatable product (10). Simultaneously, the generated air flow flows to the interior of the auxiliary characteristic inflatable product (20) via the rotation rod (21) to inflate the auxiliary characteristic inflatable product (20).

On the other hand, the rotation of the top blade set (33) in the upper chamber (312) sucks in the particles (13) from the inlet (316) and projects the particles (13) out from the outlet (317). Therefore, the particles (13) will be able to move around the interior of the hollow body (11). Furthermore, the rotation of the auxiliary characteristic inflatable product (20) inside the primary inflatable product (10) due to the rotation of the rotator (22) increases the exhibition effect and increases the attraction to the bystanders.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inflatable exhibition product comprising:

a primary inflatable product having a hollow body, a hollow support formed on a bottom of the hollow body and communicating with the hollow body and particles randomly received inside the hollow body;

an auxiliary characteristic inflatable product received inside and communicating with the hollow body;

an air blower assembly mounted at the bottom of the hollow body and on top of the hollow support and having a hollow casing provided therein an upper chamber to receive therein a top blade set and a lower chamber to receive therein a bottom blade set, wherein an inlet is defined in a top face forming the upper chamber and an outlet is defined in a side face forming the upper chamber to respectively communicate with an interior of the hollow body such that rotation of the bottom blade set is able to inflate the auxiliary characteristic inflatable product and the primary inflatable product and rotation of the top blade set is able to suck in the particles from the inlet and project them out to the interior of the hollow body from the outlet, wherein the hollow casing further has a motor room formed below the lower chamber to receive therein a motor which drives the bottom blade set and the top blade set to rotate.

2. The inflatable exhibition product as claimed in claim 1, wherein a rotator is mounted on top of the auxiliary characteristic inflatable product to connect to an inner face of a top portion of the hollow body of the primary inflatable product and a hollow rotation rod is mounted on a bottom of the auxiliary characteristic inflatable product to connect to a side face of the support such that the auxiliary characteristic inflatable product is able to rotate inside the primary inflatable product.

3. The inflatable exhibition product as claimed in claim 2, wherein the hollow body communicates with the auxiliary characteristic inflatable product via the hollow rotation rod.

4. The inflatable exhibition product as claimed in claim 2, wherein the support has an extension pipe extending outward to connect to and communicate with a side opening defined in a side face forming the lower chamber so that the rotation of the bottom blade set is able to inflate the support as well as the primary inflatable product.

5. The inflatable exhibition product as claimed in claim 3, wherein the support has an extension pipe extending outward to connect to and communicate with a side opening defined in a side face forming the lower chamber so that the rotation of the bottom blade set is able to inflate the support as well as the primary inflatable product.

6. The inflatable exhibition product as claimed in claim 1, wherein the hollow support has multiple feet so that the hollow casing is above the ground.

7. The inflatable exhibition product as claimed in claim 2, wherein the hollow support has multiple feet so that the hollow casing is above the ground.

8. The inflatable exhibition product as claimed in claim 3, wherein the hollow support has multiple feet so that the hollow casing is above the ground.

9. The inflatable exhibition product as claimed in claim 4, wherein the hollow support has multiple feet so that the hollow casing is above the ground.

10. The inflatable exhibition product as claimed in claim 5, wherein the hollow support has multiple feet so that the hollow casing is above the ground.

* * * * *